US005167049A

United States Patent [19]

Gibbs

[11] Patent Number: 5,167,049

[45] Date of Patent: Dec. 1, 1992

[54] SQUARE FRAME HINGE

[75] Inventor: Edward L. Gibbs, Tulsa, Okla.

[73] Assignee: Fence Hardware Specialties, Inc., Tulsa, Okla.

[21] Appl. No.: 776,172

[22] Filed: Oct. 15, 1991

[51] Int. Cl.[5] ..... E05D 3/02; E05D 5/02; E05D 7/10

[52] U.S. Cl. ..... 16/253; 16/265; 16/387

[58] Field of Search ..... 16/252, 253, 387, 390, 16/391, 392, 265

[56] References Cited

U.S. PATENT DOCUMENTS

| | | | |
|---|---|---|---|
| 379,660 | 3/1888 | Price | 16/252 |
| 590,860 | 9/1897 | Rowe | 16/390 |
| 721,502 | 2/1903 | Carter | 16/390 |
| 1,421,794 | 7/1922 | McLaughlin | 16/265 |
| 1,793,013 | 2/1931 | Robertson | 16/253 |
| 3,268,946 | 8/1966 | Case | 16/253 |
| 4,010,504 | 3/1977 | Griffin | 16/252 |

FOREIGN PATENT DOCUMENTS

| | | | |
|---|---|---|---|
| 8720 | of 1906 | United Kingdom | 16/253 |
| 651686 | 4/1951 | United Kingdom | 16/253 |
| 897887 | 5/1962 | United Kingdom | 16/253 |
| 978647 | 12/1964 | United Kingdom | 16/390 |
| 983414 | 2/1965 | United Kingdom | 16/252 |

*Primary Examiner*—John Sipos
*Assistant Examiner*—Donald M. Gurley
*Attorney, Agent, or Firm*—William S. Dorman

[57] ABSTRACT

The invention is a gate hinge comprising a male half with a rod extending upward from it and a female half with a sleeve which fits over the rod and swivels on the rod. Both the male and female halves have "U"-shaped portions extending outward at right angles to the longitudinal axis of the rod. Each "U"-shaped portion has two legs which fit around either a square gate post or a square fence post. Each leg has a square shoulder which fits around either the gate post or the fence post and an opening through which a bolt extends as a means of securing the hinge to the posts. The square shoulders force proper alignment of the hinge with the posts when the bolts are tightened and prevent up and down movement or tilt of the hinge when a heavy load is applied, such as a heavy gate.

4 Claims, 1 Drawing Sheet

SQUARE FRAME HINGE

BACKGROUND OF THE INVENTION

1. Field of the Invention

The present invention relates to a new and improved gate hinge. Specifically, the present invention relates to a gate hinge employing two halves, one male half and one female half, the two halves fitting together and swivelling at their junction.

2. The Prior Art

Gate hinges for connecting a gate to a fence have been known in the art for many years. Prior art hinges normally consist of two halves, a lower male half provided with a projection and an upper female half provided with an aperture into which the projection of the male half inserts and swivels. Both halves are "U"-shaped with the two legs of the "U" of the male half being secured around a fence post and the two legs of the "U" of the female half being secured around a gate post.

The gate will swing between an open and closed position whenever two or more hinges are attached in the manner previously described.

The problem with these prior art hinges relates to how they attach to square gate or fence posts. The term post or posts when used hereafter will generally refer to either a square gate post or a square fence post. The legs of the "U"-shaped portion of these hinges stick out straight beyond the posts. These straight legs normally have openings through which a bolt is inserted to fasten the half to the post. Generally, the openings are positioned in the legs so that the bolt does not touch the post when the bolt is tightened. Because neither the legs of the "U"-shaped half nor the bolt fit against the post o the side of the post where the bolt is located, the hinge tends to tilt or slip up or down when a load, such as a heavy gate, is placed on it.

The present invention solves this problem by utilizing square shoulders on the legs where they extend around the posts. The legs have openings near the ends of the legs through which a bolt or other fastener is inserted to secure the half to the post. When the bolt or fastener is tightened, the square shoulders fit securely against the post, forcing alignment of the half with the post. The shoulders prevent the hinge from tilting or slipping on the posts when a heavy load is applied to one half of the hinge, such as would occur when a heavy gate is attached to the hinge.

SUMMARY OF THE INVENTION

Briefly, the present invention is directed to a new type of gate hinge. The hinge has two halves, a male half with a projection extending upward and a female half with an aperture which fits over the projection and swivels thereon. Each half has a "U"-shaped portion which extends outward at right angles to the longitudinal axis of the projection. The "U"-shaped portion of the male half has two legs which fit a square fence post and, the "U"-shaped portion of the female half has two legs which fit around a square gate post. Each leg has an opening in it through which a bolt inserts for securing the hinge to the gate post and fence post. Each leg has a square shoulder which forces proper alignment of the hinge with either the gate post or fence post when the hinge is tightened into place, thus preventing up and down movement or tilt of the hinge when a heavy load is attached to the hinge, such as a heavy gate.

DETAILED DESCRIPTION OF THE PREFERRED EMBODIMENTS

Figure 2:
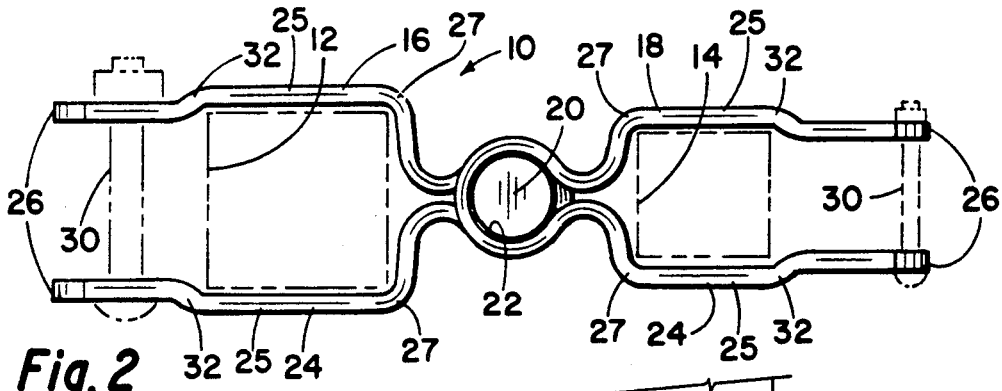
FIG. 2 is a top plan view of the square frame hinge taken along the line 2—2 of FIG. 1.
Figure 1:
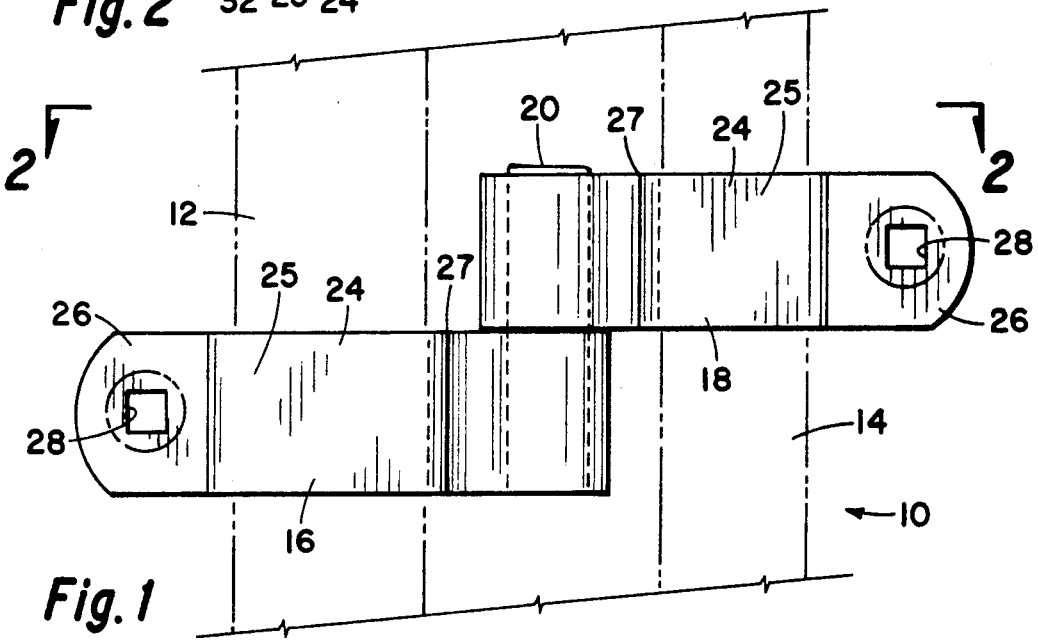
FIG. 1 is a side view of a square frame hinge made in accordance with a preferred embodiment of the invention.

Referring to the drawings and initially to FIGS. 1 and 2, there is illustrated a hinge according to a preferred embodiment of the present invention, generally designated by the reference numeral 10. The hinge 10 is shown attached to a fence post 12 and a gate post 14. (Both fence post 12 and gate post 14 are shown by dashed lines in FIGS. 1 and 2).

Figure 3:
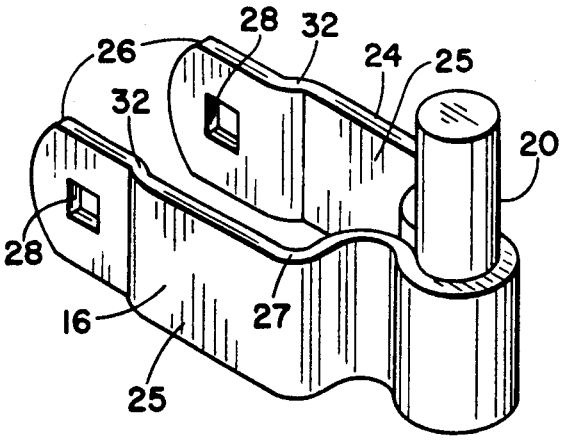
FIG. 3 is an isometric projection, on an enlarged scale, of the male half of the present invention.
Figure 4:
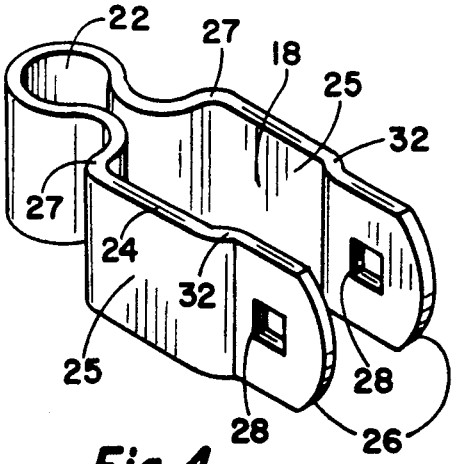
FIG. 4 is an isometric projection, on an enlarged scale, of the female half of the present invention.

Now referring to FIGS. 3 and 4, the hinge has two halves, a lower male half 16 and upper female half 18. The male half 16 has a projection 20 extending from it in an orientation parallel to the longitudinal axis of the posts 12 and 14. The female half 18 has an aperture 22 into which the projection 20 inserts. The two halves 16 and 18 of the hinge 10 articulate where the projection 20 and the aperture 22 meet, allowing a gate (not shown) attached to the hinge 10 by the gate post 14 to swing between an open and closed position.

Each half 16 and 18 of the hinge 10 has a "U"-shaped portion 24 extending away from the projection 20 and the aperture 22 and perpendicular to the longitudinal axis of the projection 20. Each "U"-shaped portion includes two parallel sides 25 which constitute the sides of the "U". The "U"-shaped portion 24 of the male half 16 fits around fence post 12 and the "U"-shaped portion 24 of the female half 18 fits around the gate post 14. Each "U"-shaped portion 24 has two parallel legs 26 which are parallel to the sides 25 of the "U"- shaped portion 24 but which are closer to each other than the sides 25. The legs 26 connect with the sides 25 by means of square shoulders 32. Each "U"-shaped portion 24 is provided with two right angles 27 which fit around a corner of the fence post 12 or the gate post 14. Each leg 26 is provided with an opening 28 through which a bolt 30 inserts. Each square shoulder 32 fits around a corner of either the fence post 12 or the gate post 14.

The distance between the right angles 27 of the male half 16 is the same as the length of one side of the square fence post 12, all four sides of the square fence post 12 being the same length. The distance between the right angles 27 of the female half 18 is the same as the length of one side of the square gate post 14, all four sides of the square gate post 14 being the same length.

The square shoulders 32 are located on the legs 24 of the male half 16 so that the distance between each square shoulder 32 and the right angle 27 adjacent to that square shoulder 32 is the same as the distance between the two right angles 27 of the male half 16.

The square shoulders 32 are located on the legs 24 of the female half 18 so that the distance between each square shoulder 32 and the right angle 27 adjacent to that square shoulder 32 is the same as the distance between the two right angles 27 of the female half 18.

Thus, when the male half 16 is positioned on the fence post 12 and the female half 18 is positioned on the gate post 14 and the bolts 30 are tightened, the square shoulders 32 and the "U" portions 24 surround and enclose the gate post 14 and the fence post 12 forcing the hinge halves 16 and 18 to align so the "U"-shaped portions 24 are at right angles to the longitudinal axis of the posts 12 and 14. Once the bolts 30 are tightened, the square shoulders 32 hold the hinge so it can not slip up and down on the posts 12 and 14 or tilt under the weight of a heavy gate (not shown).

Whereas the present invention has been described in particular relation to the drawings attached hereto, it should be understood that other and further modifications, apart from those shown or suggested herein, may be made within the spirit and scope of this invention.

What is claimed is:

1. A gate hinge for attaching a gate with square gate posts to a fence with square fence posts comprising a male half and a female half, the male half having a projection extending upwardly from it, the female half having an aperture, the projection inserting into the aperture and the two halves articulating where the projection and aperture meet, both halves having a "U"-shaped portion extending at right angles from the longitudinal axis of the projection and aperture, respectively, the male half "U"-shaped portion having two right angles forming a set of curves for the "U"-shaped portion and two legs fitting around the square fence post, the female half "U"-shaped portion having two right angles forming a set of curves for the "U"-shaped portion and two legs fitting around the square gate post, the distance between the right angles of the mate half being the same as the length of one side of the square fence post, the distance between the right angles of the female half being the same as the length of one side of the square gate post, each leg having a square shoulder to fit against its associated post, the right angle and shoulder of both the male and female halves being located in a spaced relationship in each leg of the male and female halves, the square shoulders being located on the legs of the male half so that the distance between each square shoulder and the right angle adjacent to that square shoulder is the same as the distance between the two right angles of the male half, the square shoulders being located on the legs of the female half so that the distance between each square shoulder and the right angle adjacent to that square shoulder is the same as the distance between the two right angles of the female half, and each leg of the male and female halves being provided with an extension beyond the shoulders having openings therein through which a fastener inserts to secure the hinge to both the fence post and the gate post.

2. A gate hinge according to claim 1 wherein the fastener is a bolt.

3. A gate hinge according to claim 1 wherein the female half is positioned on top of the male half so that the aperture is held in place on the projection by the force of gravity.

4. A gate hinge according to claim 1 wherein the projection is secured to the male half by means of a weld.

* * * * *